United States Patent [19]

Roos

[11] 4,384,664

[45] May 24, 1983

[54] DEVICE FOR DISPENSING SERIAL NUMBERS ATTACHED ON A STRIP OF PAPER

[76] Inventor: Johannes Roos, Hofzicht 14, Wateringen, Netherlands

[21] Appl. No.: 224,987

[22] Filed: Jan. 14, 1981

[30] Foreign Application Priority Data

Jan. 16, 1980 [NL] Netherlands ..... 8000263

[51] Int. Cl.[3] ..... B26F 3/02

[52] U.S. Cl. ..... 225/106; 225/13; 225/14; 225/52; 225/90

[58] Field of Search ..... 225/12–15, 225/9, 51, 52, 90, 106

[56] References Cited

U.S. PATENT DOCUMENTS

| | | | |
|---|---|---|---|
| 843,579 | 2/1907 | Burr et al. | 225/106 |
| 2,839,139 | 6/1958 | Vogt | 225/90 X |
| 3,045,883 | 7/1962 | Andrews et al. | 225/90 |
| 3,885,724 | 5/1975 | Ehrlund | 225/77 |
| 4,204,618 | 5/1980 | Reed et al. | 225/106 |
| 4,267,949 | 5/1981 | Hemgren | 225/13 X |

*Primary Examiner*—Frank T. Yost

*Attorney, Agent, or Firm*—Sheridan Neimark; Karl W. Flocks

[57] ABSTRACT

A device for dispensing serial numbers, which have been attached consecutively in the longitudinal direction on a strip of paper being brought in the shape of a roll, said strip of paper being provided between each two numbers with an incision line formed in such a way that by a transverse portion and two longitudinal portions of it a central lip is obtained which projects from an output edge of the device after the tearing off of a serial number, the tearing means being formed by composing the output edge of a central part parallel to the plane of the strip and transverse to the longitudinal direction of it and two lateral parts connected with the ends of the central part and constituting an angle therewith such that the lateral edges of the strip are pulled on the lateral parts of the output edge and are shifted away from each other.

6 Claims, 4 Drawing Figures

FIG.1
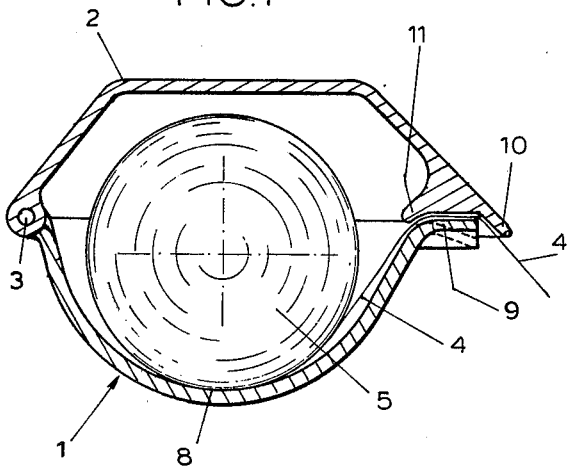
FIG. 2
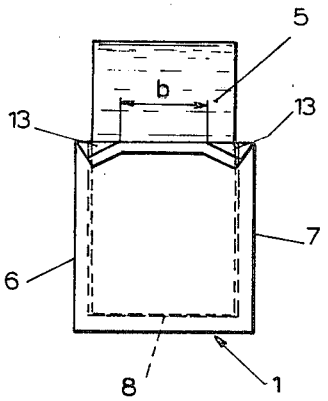
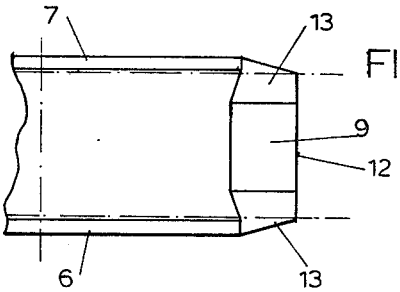
FIG.3
FIG. 4
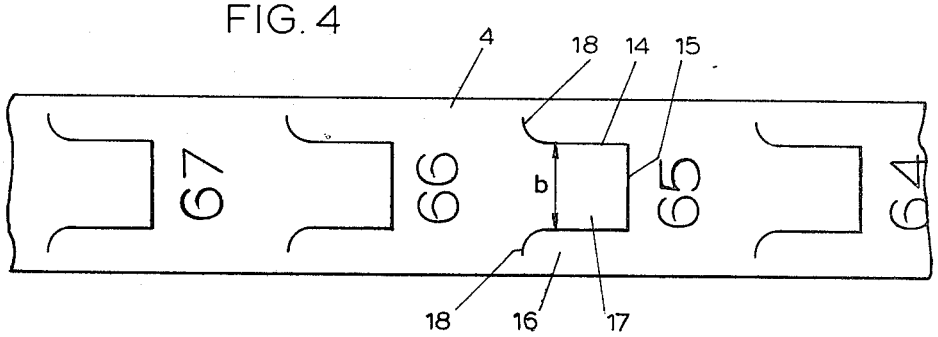

DEVICE FOR DISPENSING SERIAL NUMBERS ATTACHED ON A STRIP OF PAPER

The invention relates to a device for dispensing serial numbers, which have been attached consecutively in the longitudinal direction on a strip of paper, said strip of paper being provided between each two numbers and in the central part thereof with an incision line consisting at least of two sections, which extend essentially in the longitudinal direction of the strip, for forming the side edges which are to be torn off, of the strip, said strip of paper being brought in the shape of a roll which can be accommodated by a bowl-shaped part of the device, said bowl-shaped part, at an output section over which the strip of paper is pulled, being provided with means for tearing a serial number off the strip and the incision line being provided in such a way, that after the tearing off of a serial number a central lip of the next number projects from the output edge.

Such a device, with the strip of paper belonging thereto, is known from Dutch Patent Application No. 73 01 000, laid open for public inspection. With this known device the means for separating the serial numbers from each other, are formed by teeth, into which the edge sections of the strip must be drawn in order to tear the edge sections. For that purpose the serial number to be torn off must be pulled downwards, whereas the central section of the strip, which constitutes a lip of the next number, is kept in approximately the horizontal direction by means of a forwards projecting part of the output edge. The point of this lip section then just projects from under the edge of a cover, which delimits the device at the upper side and assures that the strip is more or less forced to be pulled downwards.

It appears in practice that such a device does not always function satisfactorily. When the strip is pulled downwards with too great a force, the longitudinal edges of the strip will come into touch with the teeth too early and will be cut through, so that the lip of the next number does not project from the device and becomes unreachable. In most cases the cover of the device can be swung away easily in order to make the end of the roll reachable, but this has the drawback that the cover opens spontaneously when a number is pulled forward too hard.

The invention overcomes these drawbacks by providing a device of the above-described type, which is characterized in that the tearing means are formed by composing the output edge of a central part parallel to the plane of the strip of paper and of two lateral parts which are connected with the ends of the central part, are symmetrical with respect to the central part and constitute an angle therewith, the angle made by the lateral parts and the central part being such, that when a strip of paper is pulled over the output edge, the output edge constituting a bending edge of the strip, the lateral edges of the strip are pulled on the lateral parts of the output edge.

It has appeared that when the strip of paper runs over the output edge and is bent out of its plane, the strip is supported sufficiently by the central part of the output edge as long as the output edge is not near a part of the strip in which the incision line is provided. When, however, the strip of paper is pulled away further and the output edge comes to lie under a part of the strip where there are the essentially longitudinal sections of the incision line, then the edge parts of the strip will no longer be supported by the central part of the output edge, but they will want to slide away over the oblique parts of the output edge, so that the side edges of the strip are pulled away in the cross direction of the central part of the strip. Thus the side edges are torn there where the incision line ends.

Preferably the output edge, seen in the plane in which the strip of paper is bent away, will extend over an angle of at least 45°. Such a bend of the strip of paper is sufficient to cause the tearing of the side edges thereof.

Preferably the output edge will have an angle of more than 90°. Thus it is obtained that the strip can be pulled away downwards almost vertically, whereas also the lip of the serial number to be pulled away projects downwards in the vertical direction from the device. So it is no longer necessary to first pull the lip away in almost the horizontal direction and then downwards, as is necessary with the above-described known device.

As with the known device, the bowl-shaped part can be closed off by a cover of which an edge part falls over the output edge. With the known device, however, the edge part of the cover must lie at some distance from the strip of paper, as it must fall outside the lip, which is pressed out of the plane of the strip of paper.

Wit the device according to the present invention, however, the edge part of the cover may fit closely to the output edge, in such a way that the strip of paper is guided between the cover and the output edge. Thus it is assured that the lip always projects from the cover in the right way, as there is no chance that the lip follows another path and is folded in the wrong direction by the cover, as may happen with the known device.

The strip of paper, which will be used preferably with the device according to the present invention, is carried out in such a way, that an incision line between each two numbers is essentially U-shaped, the legs of the U extending in the longitudinal direction towards a next number and the distance between the legs approximately equalling the width of the central part of the output edge.

In this way the central part of the strip is supported in the most favourable way by the central part of the output edge, whereas the two side edges of the strip slide away in the cross direction over the side parts of the output edge.

So in this case the side parts of the strip have the same width over a certain length. To assure that the side parts are definitely torn off at the end of the legs of the U-shaped incision line, a perforation may be provided at that place.

According to a preferable embodiment of the invention, the incision line continues at the ends of the legs of the U over a certain distance towards the edges of the strip. These continued parts form the beginning of the tearing line, so that the side edges will always be torn off at the right place.

As the side edges of the strip only have to have a width which is inferior to one/fourth of the total width of the strip, there remains a relatively wide central strip available for forming the outwards projecting lip of a serial number, which lip can be easily gripped by the user.

The invention will now be further explained with reference to an example of an embodiment, shown in the drawing, in which:

FIG. 1 schematically shows a longitudinal cross section over a device according to the present invention with a rolled up strip of paper placed therein.

FIG. 2 shows a lateral view of the device of FIG. 1, but with the cover removed and without the strip of paper running over the output edge.

FIG. 3 shows a top view of a part of the device of FIG. 1, again with cover and paper removed, and FIG. 4 shows a view of a part of a paper strip, provided with numbers and incision lines.

The device shown consists essentially of the bowl-shaped part 1 and the cover 2, which are connected with each other by means of the hinge 3.

The bowl-shaped part 1 accommodates the roll 5 consisting of a strip of paper 4, which roll is kept in place by the side walls 6 and 7 and the lower wall 8 of the bowlshaped part 1.

The strip of paper 4 to be pulled off the roll 5 is guided over the output edge 9 of the bowl-shaped part 1 and also through the legs 10 and 11 of the cover 2.

The output edge 9 consists of the central part 12 and the side parts 13. The width b of the central part 12 approximately corresponds with the distance b between the legs 14 of the U-shaped incision 15 in the strip of paper, as is shown in FIG. 4.

When the strip of paper 4 is bent over the output edge 9, the side edges 16 of the strip 4, when they are present near the output edge 9, will be bent downwards over the side parts 13 and therefore be removed in the cross direction from the central lip 17 of the strip 4.

At the ends of the legs 14 of the incision line 15 there are also parts 18, which extend in the cross direction of the incision line 15, so that the edge parts 16 of the strip 4 will be torn off at their ends, so that a pure lip 17 remains. This lip 17 projects from under the leg 10 of the cover 2 and can be gripped and pulled downwards easily.

The output edge 9 extends over a certain arc as seen in FIGS. 1 and 2 and the inner wall of the bowl-shaped part 1 gradually merges into the central part 12 and the side parts 13 of the output edge.

I claim:

1. A dispenser of serial numbers comprising a holder including a bowl shaped part, a cover over said bowl shaped part, and an output section at one end of said holder formed by said bowl shaped part and said cover;

a strip of paper in the shape of a roll contained in said holder and accommodated by said bowl shaped part and including an incision line between each of two numbers and in the central part of said strip of paper, having longitudinal lines delineating side edges which are to be torn off and a transverse connecting line connecting ends of said longitudinal lines forming a central lip for a projecting central lip of a next following serial number;

said output section of said holder including an output edge having a central part parallel to the plane of said strip of paper being pulled through said output section, two lateral parts connected with the ends of said central part, symmetrical with respect to said central part and constituting an angle therewith, said output edge constituting a bending edge over which said strip of paper is bent, and said lateral parts and said central part angled to cause said side edges of said strip of paper to ride said lateral parts of said output edge separating said strip of paper along said incision line to the edges of said strip of paper and leaving the projecting central lip of the next following serial number.

2. The dispenser of claim 1, further characterized by said incision line having transversely diverging lines at the opposite ends from said connected ends of said incision line.

3. The dispenser of claim 1, further characterized by said transversely connecting line being of length substantially the length of said central part of said output section.

4. The dispenser of claim 1, further characterized by an edge part covering said output section with said edge part closely fitting said output edge to guide said strip of paper between said edge part and said output edge.

5. The dispenser of claim 4, further characterized by said edge part curved to turn the plane of said strip of paper at least through an angle of 45°.

6. The dispenser of claim 4, further characterized by said edge part curved to turn the plane of said strip of paper through an angle exceeding 90°.

* * * * *